United States Patent [19]

Sato et al.

[11] 4,451,323

[45] May 29, 1984

[54] PORTABLE LABEL APPLYING MACHINE

[75] Inventors: Yo Sato, Tokyo; Tadao Kashiwaba, Kitagami, both of Japan

[73] Assignee: Kabushiki Kaisha Sato, Japan

[21] Appl. No.: 503,681

[22] Filed: Jun. 13, 1983

[30] Foreign Application Priority Data

Jun. 15, 1982 [JP] Japan ..... 57-101442

[51] Int. Cl.[3] ..... B65C 9/18; B65C 11/00

[52] U.S. Cl. ..... 156/541; 156/577; 156/579; 156/584; 156/DIG. 33; 156/DIG. 48

[58] Field of Search ..... 156/384, 541, 577, 579, 156/584, DIG. 33, DIG. 48; 101/288

[56] References Cited

U.S. PATENT DOCUMENTS

| | | | |
|---|---|---|---|
| 3,420,172 | 1/1969 | Kaplan | 156/384 |
| 3,530,028 | 9/1970 | Messmer | 156/584 |
| 3,801,408 | 4/1974 | Kuring et al. | 156/584 |
| 4,008,119 | 2/1977 | Hermann | 156/577 |
| 4,377,435 | 3/1983 | Fujita | 156/577 |
| 4,414,054 | 11/1983 | Becker et al. | 101/288 |

*Primary Examiner*—Michael G. Wityshyn

*Attorney, Agent, or Firm*—Ostrolenk, Faber, Gerb & Soffen

[57] ABSTRACT

A portable label applying machine comprises a label cassette having a supporting section for supporting a roll of a label strip, a separating section for inverting the backing paper strip alone so as to cause the labels to separate from the backing paper strip and a guide section for guiding the backing paper strip. It also comprises an applier having a feeding mechanism and an applying section. The feeding mechanism has the label cassette detachably mounted thereon and transfers the backing paper strip in cooperation with a manual lever, so as to cause separation of the labels from the backing paper strip at the separating section. The applying section applies the separated labels to goods. An auxiliary separating member is mounted at a position in front of the labels along their feeding direction and in front of the separating section, whereby a label which might not separate from the backing paper strip is lifted off that strip by the auxiliary separating member.

12 Claims, 24 Drawing Figures

PORTABLE LABEL APPLYING MACHINE

BACKGROUND OF THE INVENTION

1. Field of the Invention

The present invention relates to a portable label applying machine and particularly to the means for separating individual label pieces sequentially from a backing paper strip and for applying them to articles such as sales goods. The present invention relates to a portable label applying machine which is simple in structure, is easy to handle and is capable of allowing clear printing. The invention herein is an improvement over the machine shown in U.S. application Ser. No. 452,707, filed Dec. 23, 1982, by the inventors hereof. Other features disclosed herein can be found in U.S. application Ser. No. 452,705, filed Dec. 23, 1982, by the inventors hereof and other persons.

2. Description of the Prior Art

A label applying machine of this type is frequently used in supermarkets or the like. It is a portable label printing/applying machine which is generally called a hand-held labeler. The hand-held labeler of this type comprises a supporting section for supporting a roll of a label strip, and that strip comprises non-printed label pieces sequentially adhered on a backing paper strip. A printing section prints on the label pieces. A feeding section feeds the label strip. A separating section separates each printed label piece from the backing paper strip of the label strip and feeds the separated label piece into the machine. The labeler can be manually operated for printing, feeding and separating the label pieces and for affixing them on articles by pressure.

The hand-held labeler is mainly used to apply label pieces, referred to as labels hereinafter, at sales counters of various goods. However, when a hand-held labeler of this type is used for printing and applying bar code labels for the recently developed point-of-sale system, the following problems are encountered:

1. Since the bar codes are read by an OCR, the widths and intervals of bar codes must be precise. However, with a simple printing head of the type generally mounted on a hand-held labeler, the bar codes may not be correctly printed due to the lack of structural precision of the printing head or to an excess/short supply of ink applied to the printing surface by an ink roller. As a result, printed bar codes are frequently erroneously read by an OCR.

2. Because of the sizes of standard printed bar codes, the printing head for printing bar codes is large as compared with a printing head for printing general characters. A hand-held labeler for printing bar codes is therefore relatively bulky and heavy, which results in handling difficulties and user-fatigue.

3. A bar code must have a check digit. However, due to the size or structural limitations of a hand-held labeler, an automatic calculation function of the check digit is difficult to incorporate. For this reason, check digits must be seprately calculated and set in the printing head, resulting in user inconvenience.

4. When labels having low rigidity or strong adhesion to the backing paper strip are used in a hand-held labeler, separation of the labels from the backing paper strip may not be performed smoothly. In addition, labels may be erroneously printed or become jammed in the labeler.

Since a hand-held bar code labeler has the above disadvantages, a method has already been proposed in which bar codes are printed on a label strip with a desk-type printer. The printed labels are sequentially separated form the backing paper strip by hand and are then applied to the goods. However, with this manual method, the label application speed is significantly slowed, resulting in a low working efficiency. Furthermore, printed bar codes on the labels may become blurred upon contact with fingers of the person applying the labels. Hand application can be avoided by using the applying machine shown in aforesaid U.S. application Ser. No. 451,707. But, the printed labels may not be properly automatically separated from a backing paper strip as the backing paper web is being fed.

In view of the foregoing situation, it has been desired to develop a device which allows correct and efficient printing of bar codes on labels and application of printed labels to goods.

BRIEF SUMMARY OF THE INVENTION

It is, therefore, the principal object of the present invention to provide a portable label applying machine which is free from the above-described disadvantages in the conventional art.

It is another object of the present invention to provide a portable label applying machine which is easy to handle, improves the label application operation, and lessens user-fatigue.

It is still another object of the present invention to provide a portable label applying machine which allows application of clearly printed labels to goods without blurring the printed bar codes.

It is a further object of the present invention to assure separation of labels from their backing paper strip during label application.

It is still another object of the present invention to provide a portable label applying machine which is compact in size and relatively easy to operate, is easy to manufacture, causes problems less frequently, and is usable over a long period of time.

The present invention provides a portable label applying machine comprising a label cassette having a supporting section for supporting a roll of a label strip, which strip consists of labels sequentially adhered on a backing paper strip. A separating section inverts the backing paper strip alone so as to cause the labels to separate from the backing paper strip. A guide section guides the inverted separated backing paper strip. There is an applier having a feed mechanism and an applying section. The label cassette is detachably mounted on the feed mechanism, and that feed mechanism transfers the inverted backing paper strip, in cooperation with a manual operation, so as to separate the labels from the backing paper strip. The applying section applies the separated labels to goods. An auxiliary label from the backing paper separating member is mounted generally at the position at which the backing paper strip is inverted, and preferably forward of the inversion position and of the labels in the direction of travel of the labels.

BRIEF DESCRIPTION OF THE DRAWINGS

The foregoing and other objects of the present invention will become apparent from the following description of preferred embodiments taken in connection with the accompanying drawings, in which:

FIGS. 10A and 10B show the cassette set in the applier, wherein FIG. 10A is a sectional view thereof, and FIG. 10B is a side view with a frame of the machine being removed;

FIGS. 11A and 11B show the applier in which its hand lever is squeezed to an intermediate degree, wherein FIG. 11A is a sectional view of the main part thereof, FIG. 11B is a sectional view along the line A—A thereof.

FIGS. 12A and 12B show the applier in which its hand lever is completely squeezed, wherein FIG. 12A is a sectional view thereof and FIG. 2B is a side view thereof with the machine frame being removed;

DETAILED DESCRIPTION OF THE PREFERRED EMBODIMENTS

Preferred embodiments of the present invention are now described with reference to the accompanying drawings.

Figure 1:
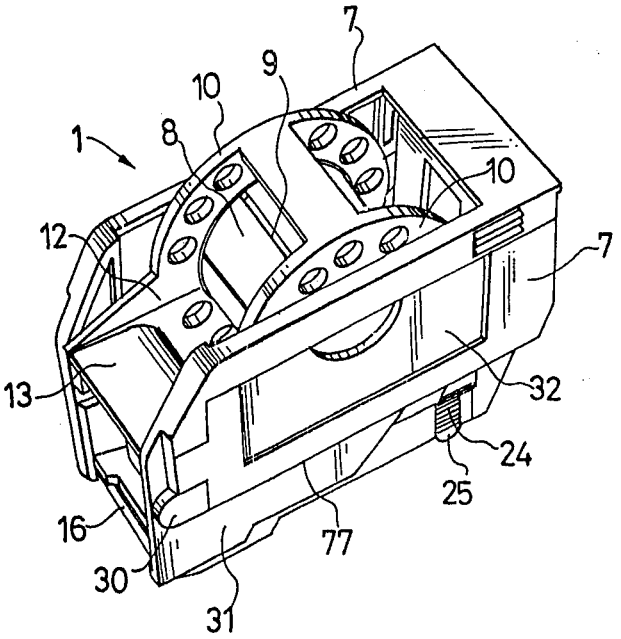
FIG. 1 is a perspective view of a label cassette of a label applying machine according to an embodiment of the present invention.
Figure 2:
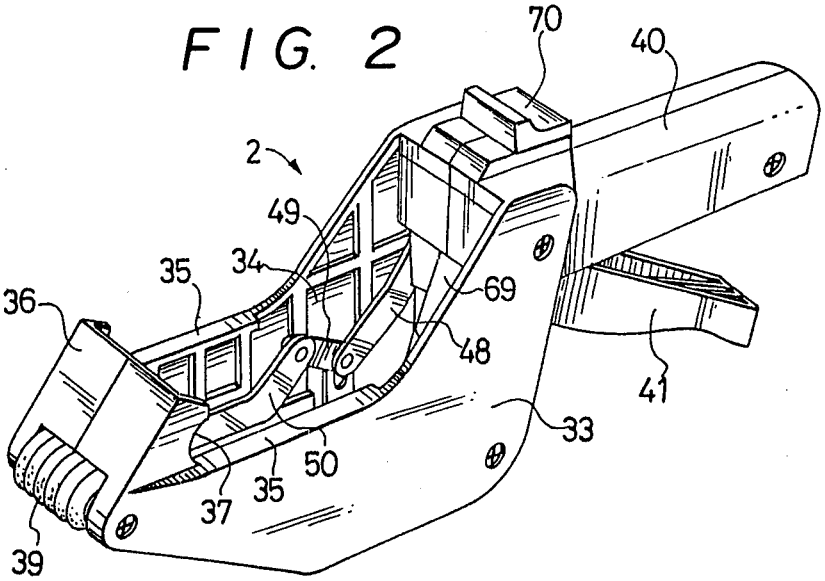
FIG. 2 is a perspective view of the overall applier.

A label applying machine of the present invention mainly comprises a label cassette 1 (FIGS. 1 and 3) and an applier 2 (FIG. 2). The label cassette 1 supports a roll of label strip 4. The cassette is detachably mounted on the applier 2. Upon manual operation thereof, the applier 2 feeds the label strip 4, separates a label 6 from a backing paper strip 5, and applies the label 6 to an article.

Figure 9:
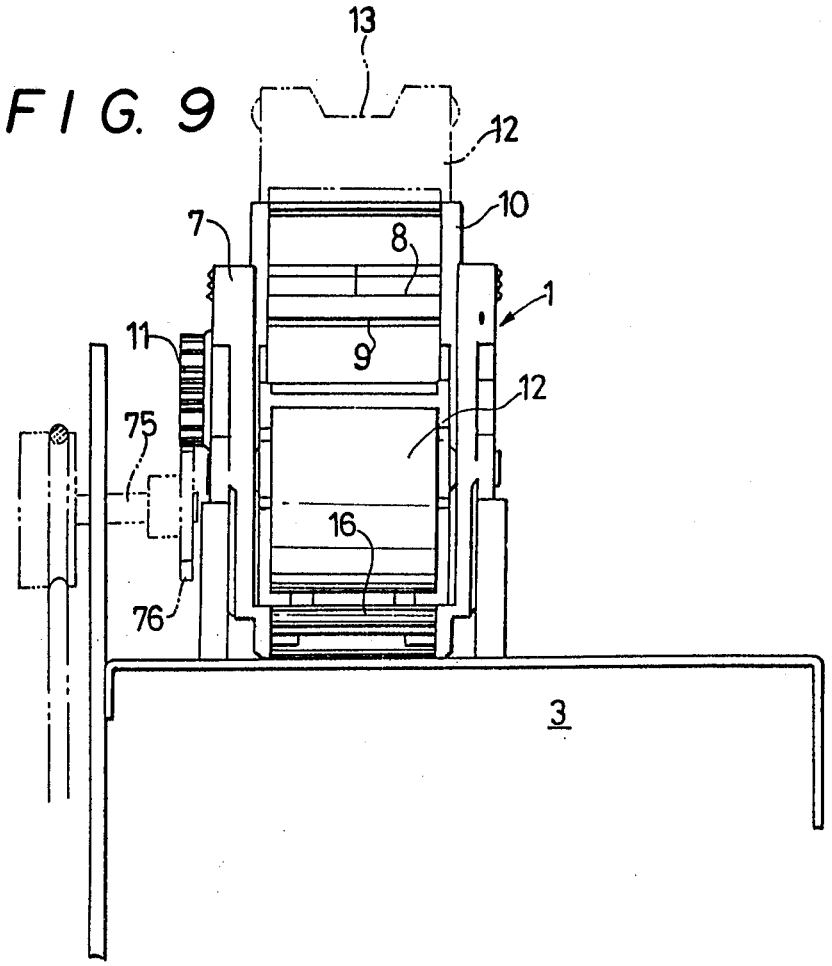
FIG. 9 is a front view wherein the label cassette is set in a printer.

A cylindrical core 8 is rotatably mounted at the center of a frame 7 of the label cassette 1 between the two lateral sides of the cassette. A number of slits 9 are formed on the outer surface of the core 8. When the label strip 4 is wound on the core, the leading edge of the strip is inserted in one of the slits 9. At one end of the core 8, a small diameter gear 11 is arranged, as shown in FIG. 9. The gear 11 projects outward through the frame 7.

A pivotal member 12 is pivotally mounted on a pair of annular projections 80 which are formed at outer surfaces of the core 8, which oppose the inner wall surfaces of the frame 7. The proximal ends of the side plates of the pivotal member 12 terminate into circular guide plates 10 which prevent the label strip 4 wound on the core 8 from deviating sideways. The distal ends of the side plates are connected to each other and terminate into an arcuate label holder 13.

Figure 3:
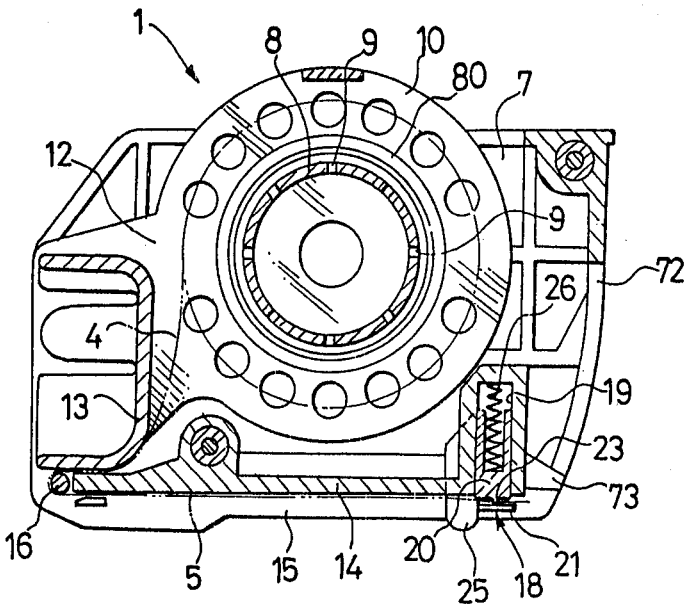
FIG. 3 is a sectional view of the label cassette shown in FIG. 1.

A backing paper strip guide groove 15 is formed continuously from the distal end to the proximal end of the bottom surface of the label cassette 1, as shown in FIG. 3. A pair of pawl guides 17 (FIG. 5) are formed longitudinally in a bottom cover 14 closing the top of the groove 15. An inverting pin 16 for having the backing paper strip wrapped around it for inverting the feeding direction of the backing paper strip 5 is arranged a short distance in front of the bottom cover 14. A backing paper strip pressing mechanism 18 is arranged at the proximal side of the bottom cover 14.

Figure 11C:
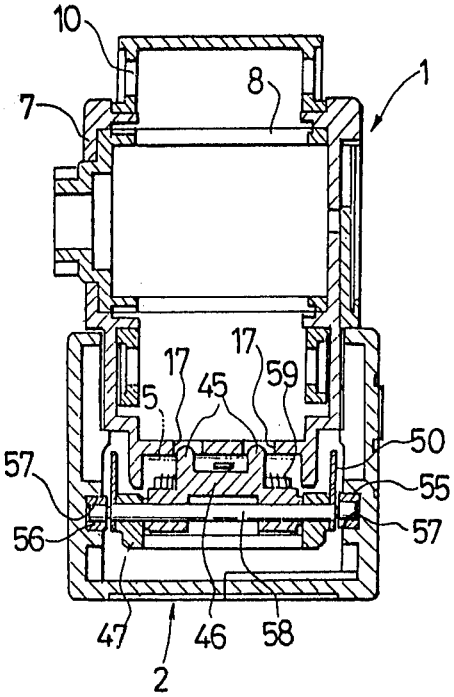
FIG. 11C is a sectional view along the line B—B thereof.
Figure 11B:
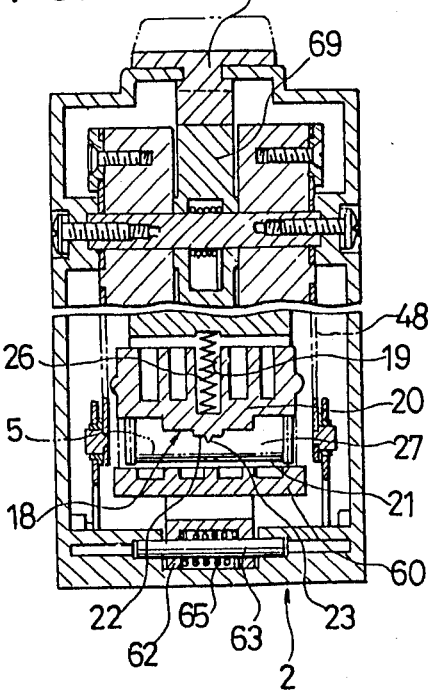

The backing paper strip pressing mechanism comprises a pressing member 20 which is vertically movably housed in a recess 19 formed in the frame 7, and comprises a counter plate 21 which is fixed at the proximal end of the backing paper strip guide groove 15. As shown in FIG. 11B, a pressing projection 22 is formed on the lower surface of the pressing member 20. A needle 23 projects downward from the central portion of the lower surface of the pressing projection 22. Catch members 24 are formed integrally with the side surfaces of the pressing member 20. Semicircular engaging lips 25 are formed at the lower portions of the catch members 24. The pressing member 20 is constantly biased downward by a spring 26 housed inside the recess 19. As a result, the engaging lips 25 normally project from the bottom surface of he label cassette 1, and the pressing projection 22 is in contact wih the upper surface of the counter plate 21.

Figure 5:
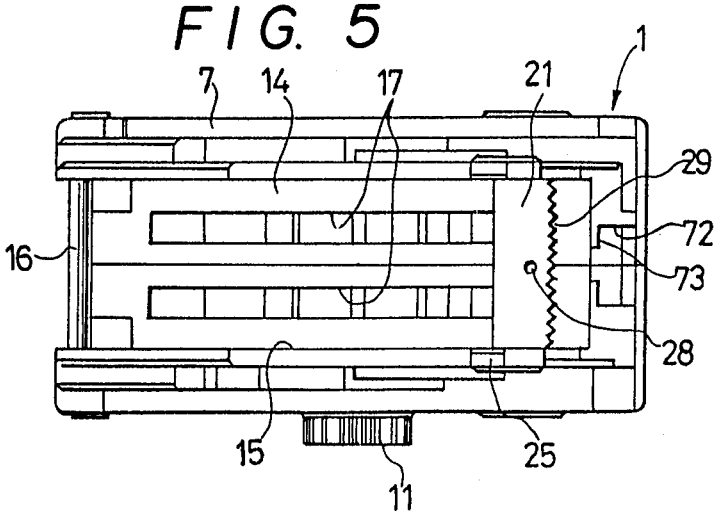
FIG. 5 is a bottom view of the cassette shown in FIG. 1.

The counter plate 21 is mounted to define a space 27 between the top surface of that plate and the bottom cover 14. the space 27 is large enough to allow passage of the backing paper strip 5. A hole 28 for receiving the needle 23 of the pressing member 20 is formed at substantially the center of the counter plate 21. A backing paper strip cutter 29 is arranged toward the proximal end of the counter plate 21 (FIG. 5).

Semicircular engaging projections 30 are formed at the distal ends of the side surfaces of the label cassette 1. The lower portions of the side surfaces of the label cassette 1 are slightly recessed to form mounting portions 31 for mounting a printer 3 and the applier 2 thereon. There is a label holding section 32.

The applier 2 is now described with reference to FIGS. 2, 6 and 7. Inside a frame 33 of the applier 2, there is an upper inner space which defines a holding section 34 for holding the label cassette 1. The upper edges of the side walls of the frame 33 are bent slightly inward to form placing members 35. A pair of semicircular engaging recesses 37 are formed at the rear sides of a front wall 36 of the frame 33. An applying roller 39 is rotatably mounted at the distal end of the frame 33. The lower portion of the front wall 36 has a label opening 38 through which the applying roller 39 projects.

The proximal end of the frame 33 extends rigidly into a hand grip 40. A hand lever 41, arranged below the hand grip 40, has a distal end that is pivotally mounted on the frame 33 by a pivot shaft 42. A return spring 43 interposed between the hand lever 41 and the hand grip 40 normally biases the hand lever 41 clockwise apart from the grip.

A feed mechanism 44 for the backing paper strip 5 is arranged below the frame 33. The feed mechanism 44 comprises a pawl member 46 having a pair of rearwardly tilted feed pawls 45 at its upper end. A holding frame 47 holds the pawl member 46. First, second and third links 48, 49 and 50, respectively, move the holding frame 47 along the longitudinal direction of the machine.

One end of the first link 48 is fixed to the hand lever 41. A roll 51 mounted on the other end of the hand lever is fitted in an elongated hole 52 formed in the second link 49. The lower end of the second link 49 is pivotally mounted on a stationary pin 53 which extends across the side walls of the frame 33. The upper end of the second link 49 is pivotally mounted to the third link 50 by a pin 54. The distal end of the third link 50 is fixed to the holding frame 47, whereby movement of the grip 41 moves the pawl member 46.

Figure 7:
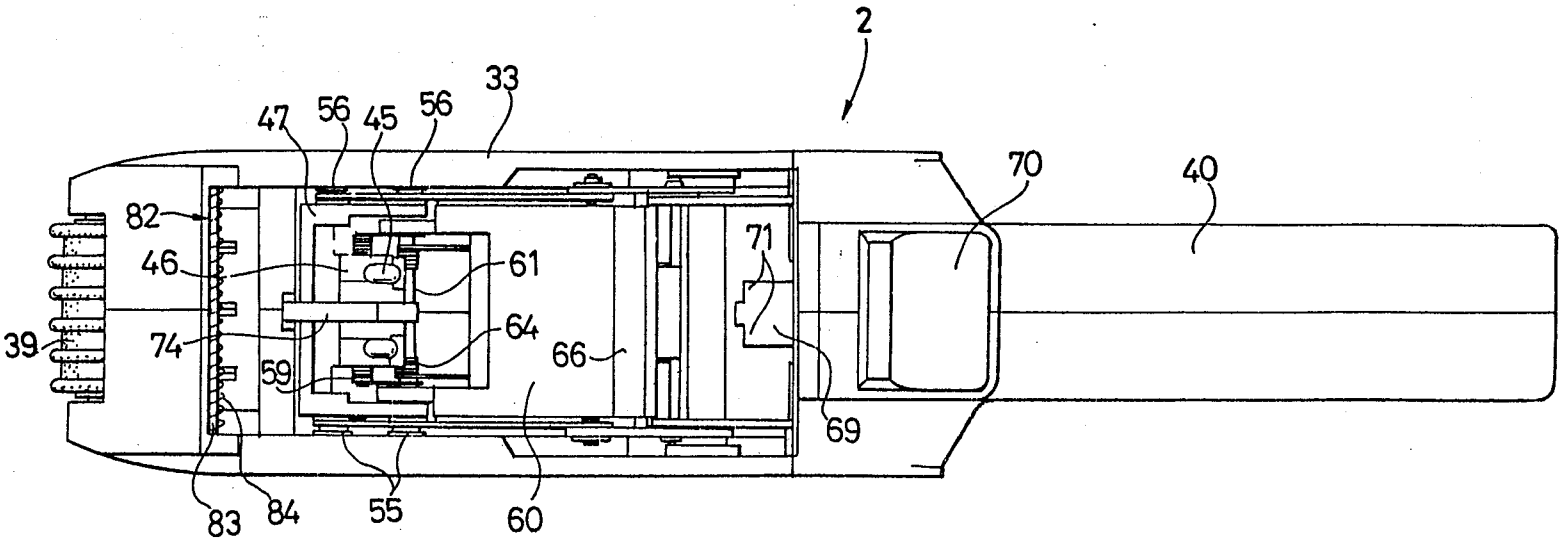
FIG. 7 is a plan view of the same.

As shown in FIG. 7, the holding frame 47 has a rearwardly open U-shape when viewed from above. A respective pair of rolls 55 and 56 are mounted on the opposite sides of the outer holding frame 47. The rolls 55 and 56 are fitted in guide grooves 57 formed in the inner walls of the frame 33 (FIG. 11C).

The pawl member 46 is pivotally mounted on a pin 58 which extends across the side walls of the holding frame 47. The pawl member 46 is constantly biased counterclockwise in FIG. 6 by a spring 59.

A press-up plate 60 is pivotally mounted on a pin 61 which extends across the proximal portions of the side walls of the holding frame 47. A support member 62 is pivotally mounted on a pin 63 which extends across the side walls of the frame 33. The press-up member 60 and the support member 62 are respectively biased counterclockwise and clockwise (FIG. 6) by springs 64 and 65, respectively. In the normal state shown in FIG. 10A, the upper surface of the support member 62 abuts against the proximal portion of the lower surface of the press-up plate 60. A tapered portion 66 is formed at the proximal portion of the upper surface of the press-up plate 60.

Figure 4:
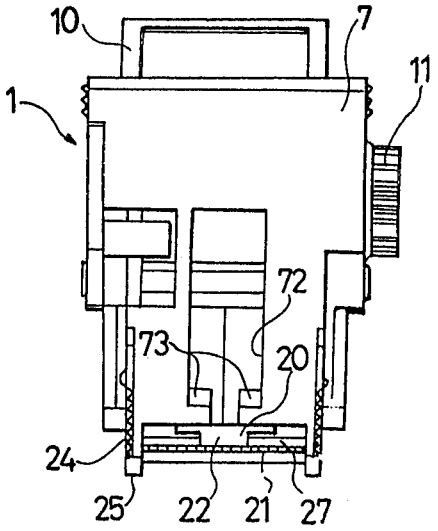
FIG. 4 is a rear view of the cassette shown in FIG. 1.
Figure 6:
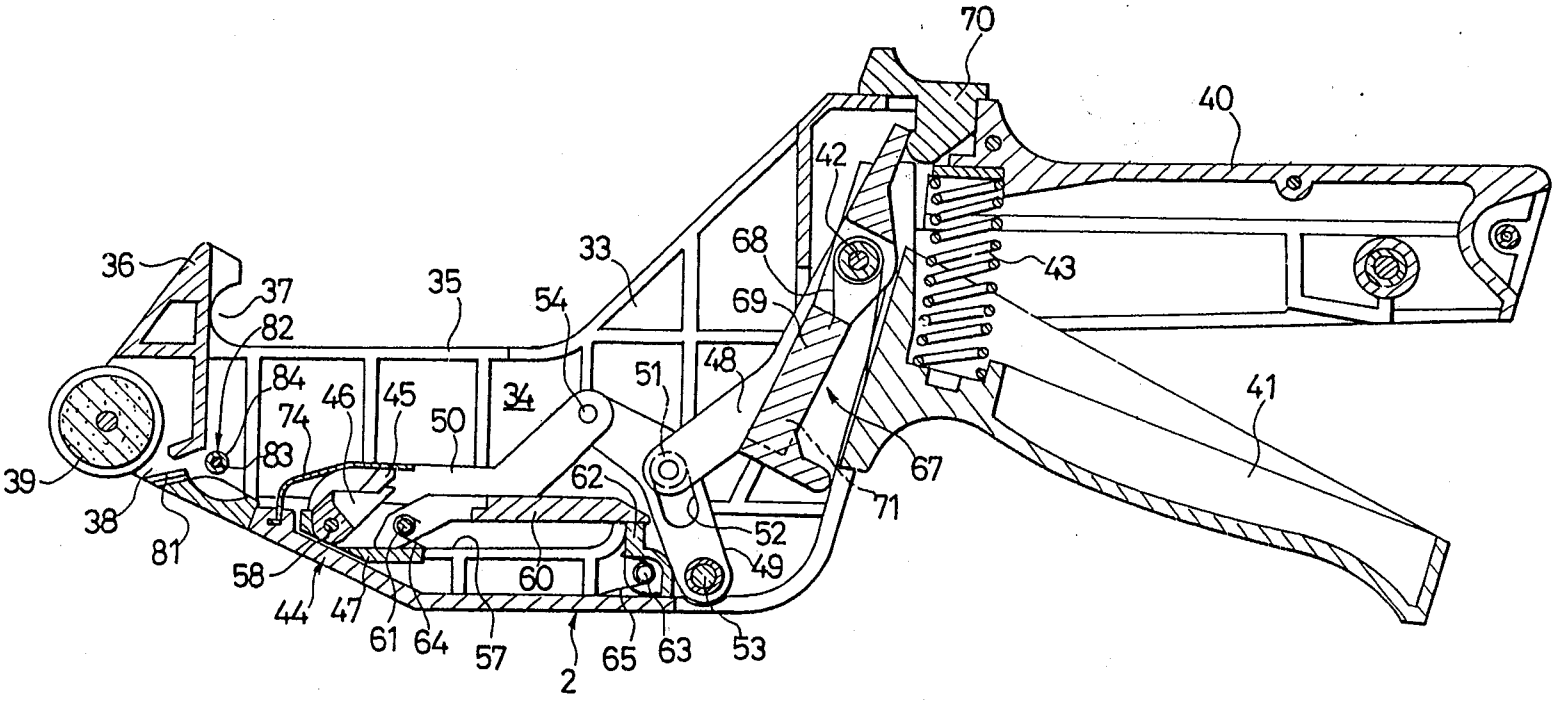
FIG. 6 is a sectional view of the applier shown in FIG. 2.
Figure 10:
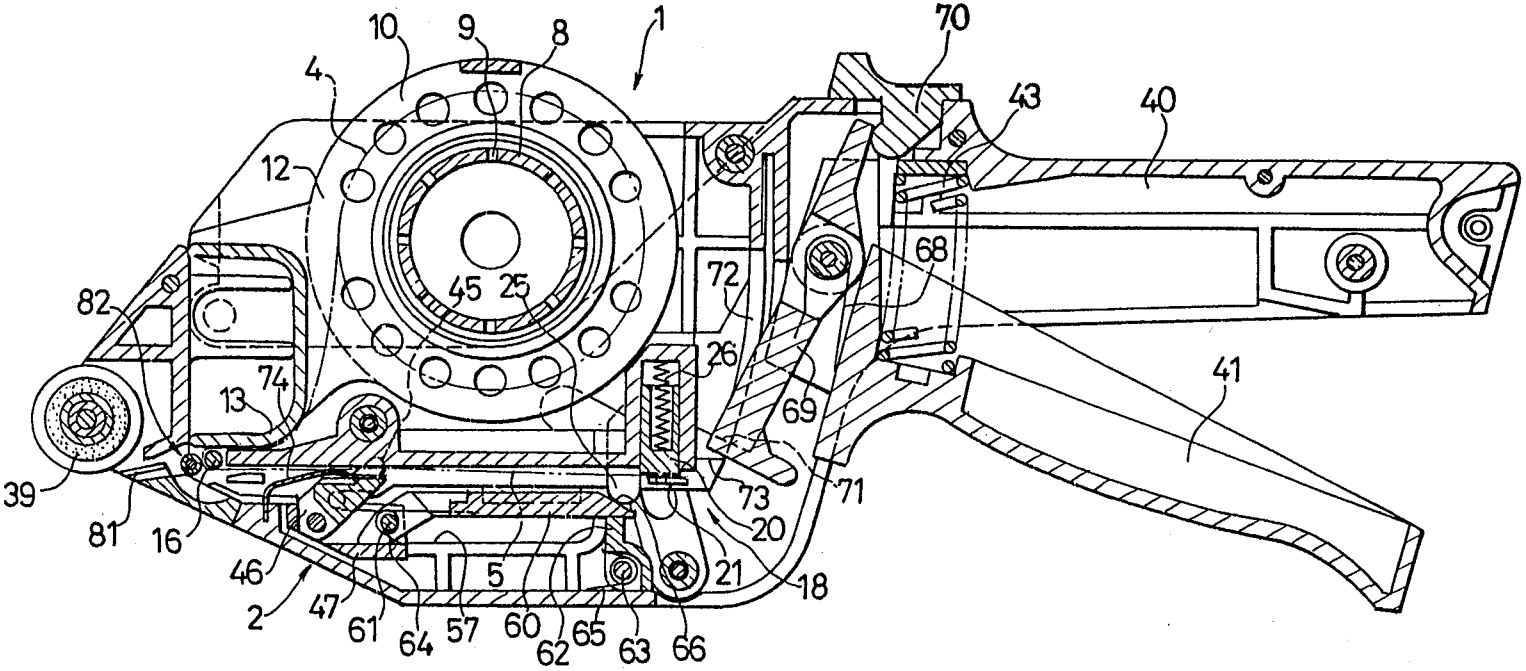
Figure 10:
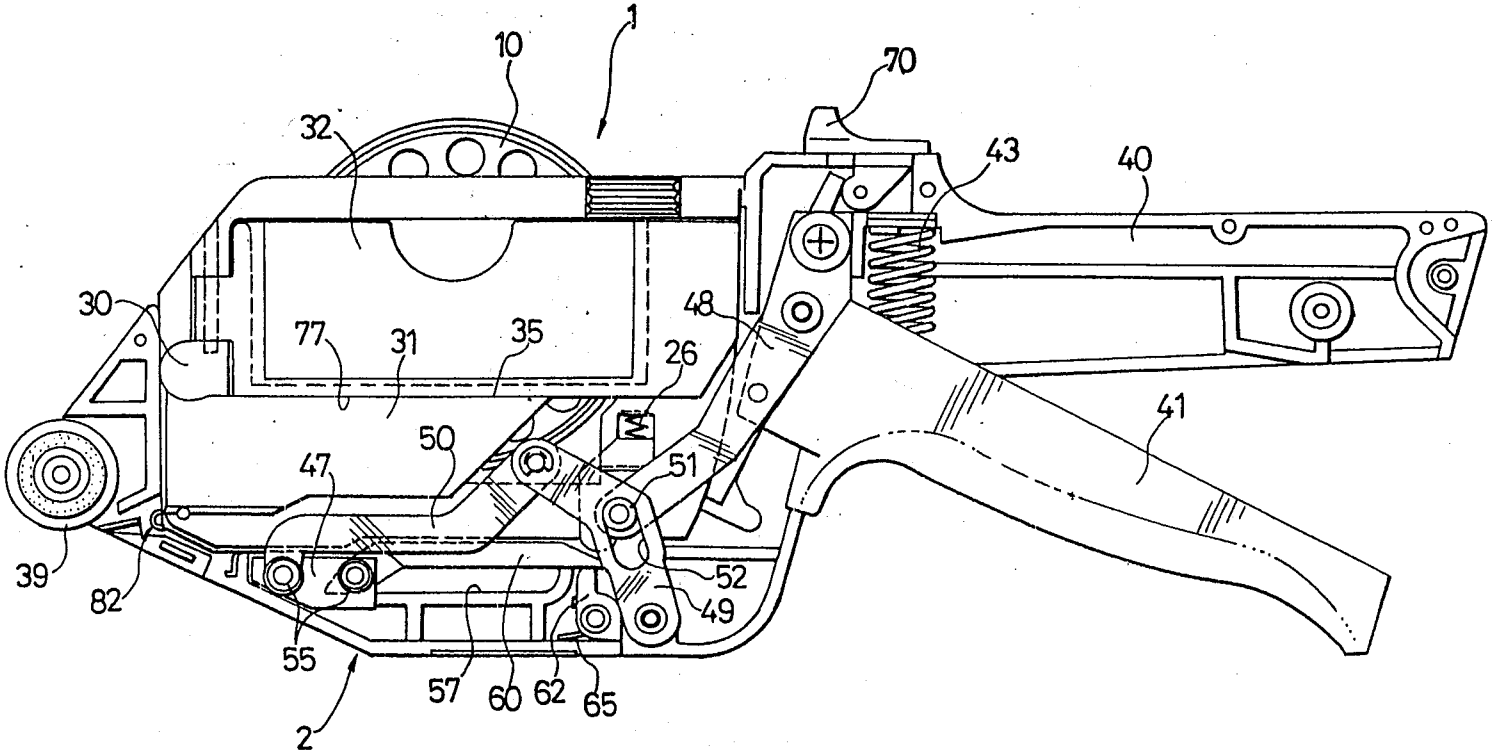

A locking mechanism 67 for facilitating mounting of the label cassette 1 is arranged at the proximal end portion of the frame 33 (FIG. 6). The locking mechanism 67 comprises a locking member 69 and an eject button 70. The locking member 69 is pivotally mounted on the frame 33 and is normally biasd clockwise by a spring 68. The eject button 70 is mounted on the upper portion of the proximal end of the frame 33 so as to be longitudinally slidable. Part of the eject button 70 is in contact with the locking member 69. When the label cassette 1 is mounted, a lower end corner 71 of the locking member 69 engages with an engaging member 73 formed at the lower end of an opening 72 formed in the rear surface of the label cassette 1 (FIGS. 4, 7 and 10B).

A backing paper strip holder 74 comprising a leaf spring is mounted on the frame 33 and is located in front of the pawl member 46.

A label supporter 81 for supporting a separated label 6 is formed at the label opening 38 located at the lower distal end of the applier 2.

An auxiliary separating member 82 is formed behind the label supporter 81. The auxiliary separating member 82 comprises a pin 83 fixed on the frame 33 (FIG. 7), and a rotary body 84 which is wound rotatably and spirally around the pin 83. When the label cassette 1 is mounted on the applier 2 as shown in Fig. 10B, the auxiliary separating member 82 is located in front of and very close to the inverting pin 16.

A silicone resin or the like is preferably coated on the rotary body 84 in order to prevent adhesion of the labels 6 to the body.

The mode of operation of the label applying machine is now described.

First, the label cassette 1 is set in the printer 3 as shown in FIG. 9 and printing is performed. Although the type of the printer 3 is not particularly limited, a thermal printer may be conveniently used. A drive source connected to the printer 3 has a rotating shaft 75 which rotates in synchronism with the feeding operation of te printed label strip 4. A gear 76 at one end of the rotating shaft 75 meshes with the gear 11 of the cassette 1.

In order to print on the labels, the pivotal member 12 of the cassette 1 is raised upright as indicated by the alternate long and short dashed line in FIG. 9. Subsequently, the distal end of the label strip 4 is drawn out from the printer 3 and is inserted into one slit 9 of the core 8 to be clamped thereby. Printing of a desired number of labels 6 may then be performed. Simultaneously, in synchronism with the feeding of the label strip 4, the core 8 is rotated through the rotating shaft 75 and the gears 76 and 11 to take up the label strip 4.

After printing is completed in this manner, the label strip 4 is cut and the label cassette 1 is removed from the printer 3. The distal or cut end of the roll of the label strip 4 is drawn out and the first few printed labels 6 thereon are separated from the backing paper strip 5. As shown in FIG. 3, the backing paper strip 5 alone is then taken from a position in front of the inverting pin 16 and is inverted or turned backward. The distal end of the inverted backing paper strip 5 is clamped between the pressing projection 22 and the counter plate 21. More specifically, the catch members 24 are moved upward by hand to move the pressing member 20 upward, and are then released. Then, the pressing member 20 is moved downward by the spring 26, and the pressing member 22 clamps the backing paper strip 5 together with the counter plate 21. At the same time, the needle 23 pierces the backing paper strip 5 to securely hold it in position. The now upright pivotal member 12 is then pivoted to the original position as shown in FIG. 3, to make the label holder 13 abut against the label strip 4.

The mounting portions 31 of the label cassette 1 are housed in the holding section 34 of the applier 2, while the engaging projections 30 at the distal end of the label cassette 1 are in engagement with the engaging recesses 37 of the applier 2. In this state, a step 77, which is formed at a position on the label cassette 1 below a label holding section 32, is placed on the placing members 35. The label cassette 1 is automatically locked by the locking mechanism 67. In this manner, when the label cassette 1 is inserted, the engaging member 73 on the cassette pivots the locking member 69 in the applier counterclockwise against the biasing force of the spring 68 as it moves downward. When the engaging member 73 moves beyond the lower end corner 71 of the locking member 69, the locking member 69 is restored to its original position by the biasing force of the spring 68. Then, the lower end corner 71 is engaged with the engaging member 73 and is locked thereby (FIGS. 10A and 10B).

Figure 8:
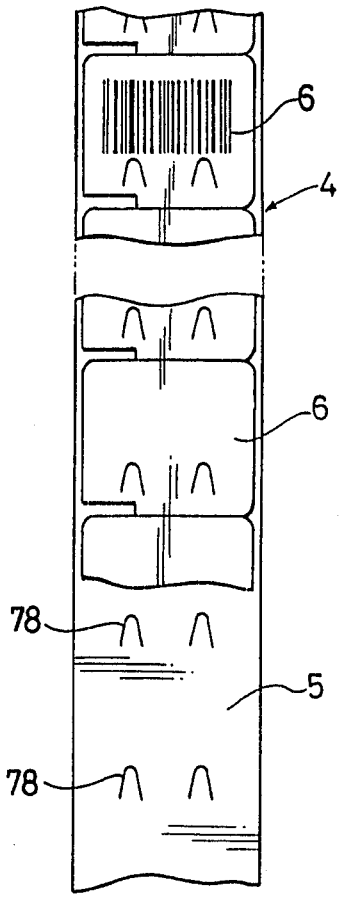
FIG. 8 is a plan view of the label strip.
Figure 11A:
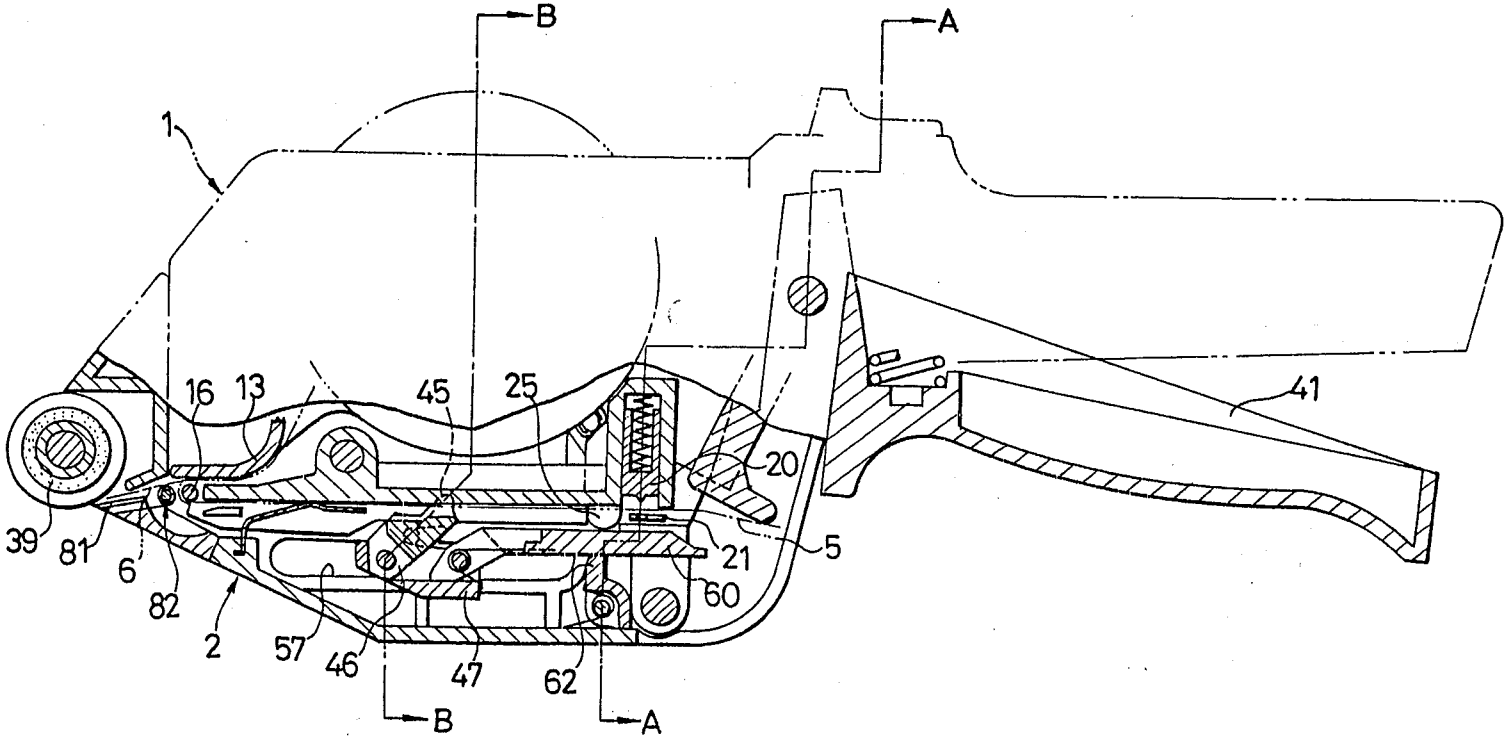

When the hand lever 41 is squeezed, the holding frame 47 is moved horizontally backward along the guide grooves 57 through the first, second and third links 48, 49 and 50 (FIG. 11A). During this horizontal movement, the feed pawls 45 of the pawl member 46 engage with notches 78 (FIG. 8) formed at equal intervals in the backing paper strip 5 so as to feed the backing paper strip 5. At the same time, the press-up plate 60 moves the engaging lips 25 of the pressing member 20 upward. As a result, the pressing against the backing paper strip by the pressing projection 22 and the needle 23 of the pressing member 20 is released, so that the backing paper strip 5 is fed to the proximal end and is exhausted to the outside of the applier 2.

Figure 12A:
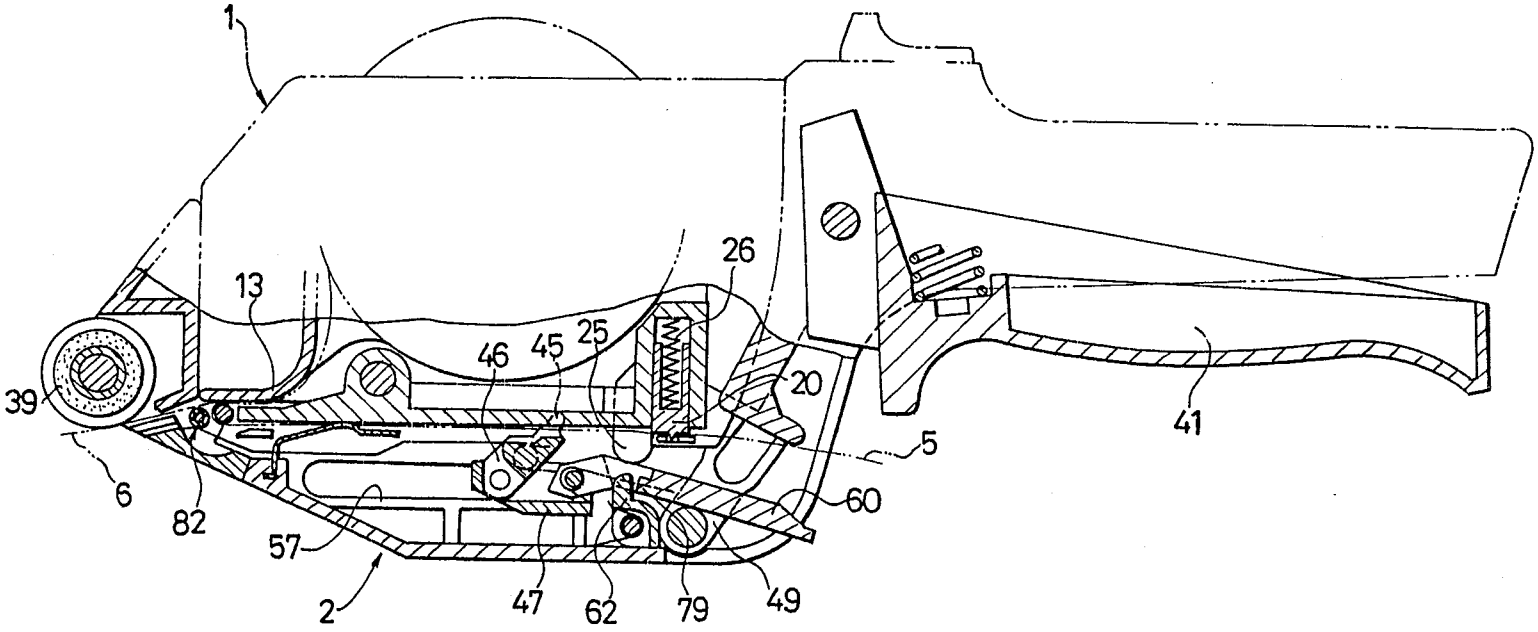
Figure 12:
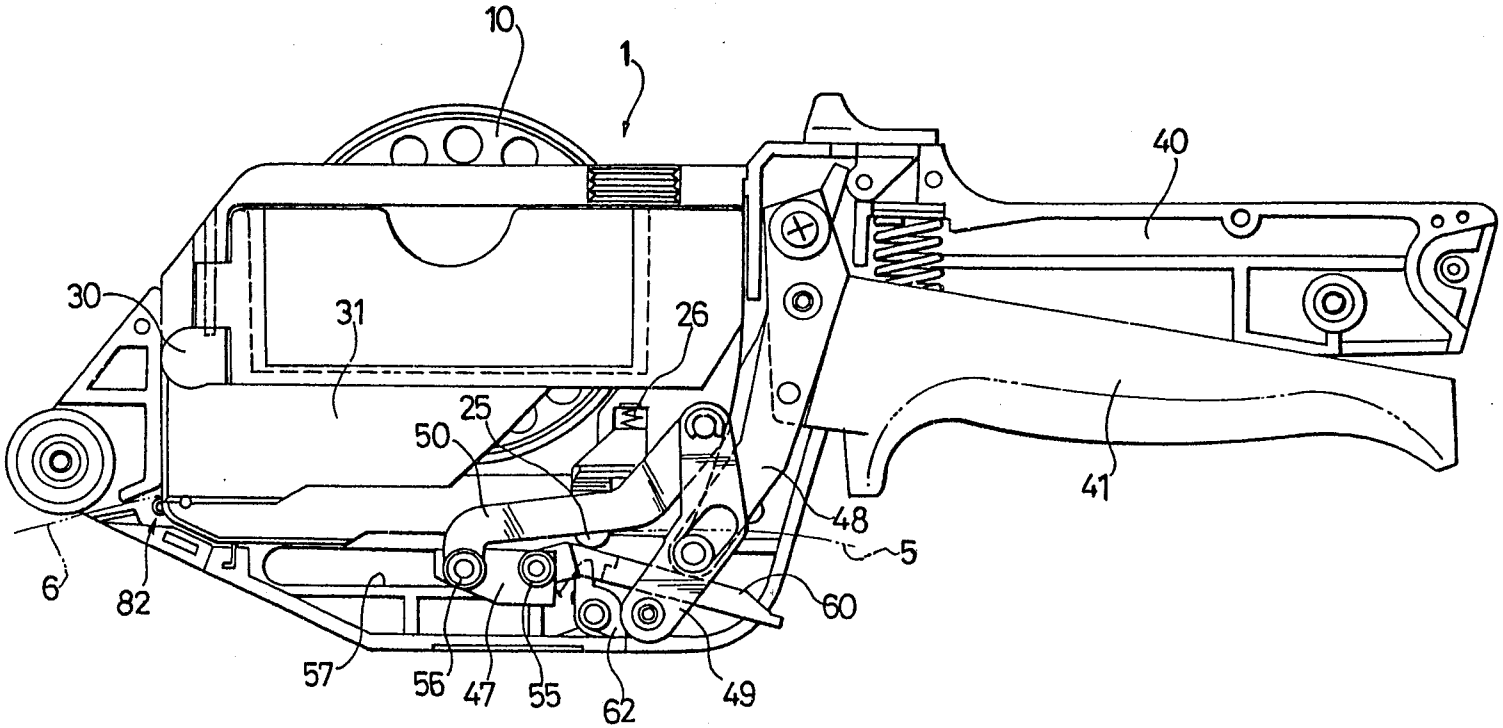

When the hand lever 41 is further squeezed, as shown in FIGS. 12A and 12B, the press-up plate 60 moves backward to disengage its lower surface from the support member 62. Therefore, the pressing member 20 moves downward to its original position while pivoting the press-up plate 60 counterclockwise by the biasing force of the spring 26. Thus, the backing paper strip 5 is held securely in position by the pressing projection 22 and the needle 23.

During the feeding movement of the backing paper strip 5, the label strip 4 is held horizontally at the position of the inverting pin 16 at the distal end portion of the machine, by the label holder 13. For this reason, the backing paper strip 5 alone is inverted in its feeding direction by a sharp angle. The labels 6 are separated from the backing paper strip 5 while the labels move toward the front and are fed to a position below the applying roller 39 through the label opening 38. The principle of operation of the auxiliary separating member 82 is described later.

Application of the labels 6 to goods is performed by the applying roller 39. For this purpose, as in a conventional hand-held labeler, the lower surface (adhesive surface) of the label 6 at a position below the applying roller 39 is abutted against an article and is applied thereto.

When the hand lever 41 is subsequently released, the hand lever 41 is returned to its original position by the biasing force of the return spring 43. Simultaneously, the holding frame 47 is moved forward to the position shown in FIGS. 10A and 10B through operation of the first, second and third links 48, 49 and 50. During this forward movement of the holding frame 47, a lower distal end 79 (FIG. 12A) of the press-up plate 60 abuts against the support member 62. However, since the biasing force of the spring 26 urging the press-up plate upward is larger than the sum of the biasing forces of the springs 64 and 65, the support member 62 is pivoted counterclockwise and the press-up plate 60 moves forward by sliding along the lower surface of the engaging lips 25 without pushing the engaging lips 25 upward. As a result, the backing paper strip 5 remains fixed in position by the pressing member 20 and is not returned to the front by the forward movement of the pawl member 46. When the feeding pawls 45 of the pawl member 46 disengage from the notches 78 of the backing paper strip 5, the pawl member 46 pivots clockwise against the biasing force of the spring 59. The pawl member 46 then returns to its original position shown in FIG. 10A, thereby sliding along the lower surface of the backing paper strip 5 so as to engage with the notches 78 of the backing paper strip 5 again.

Figure 13:
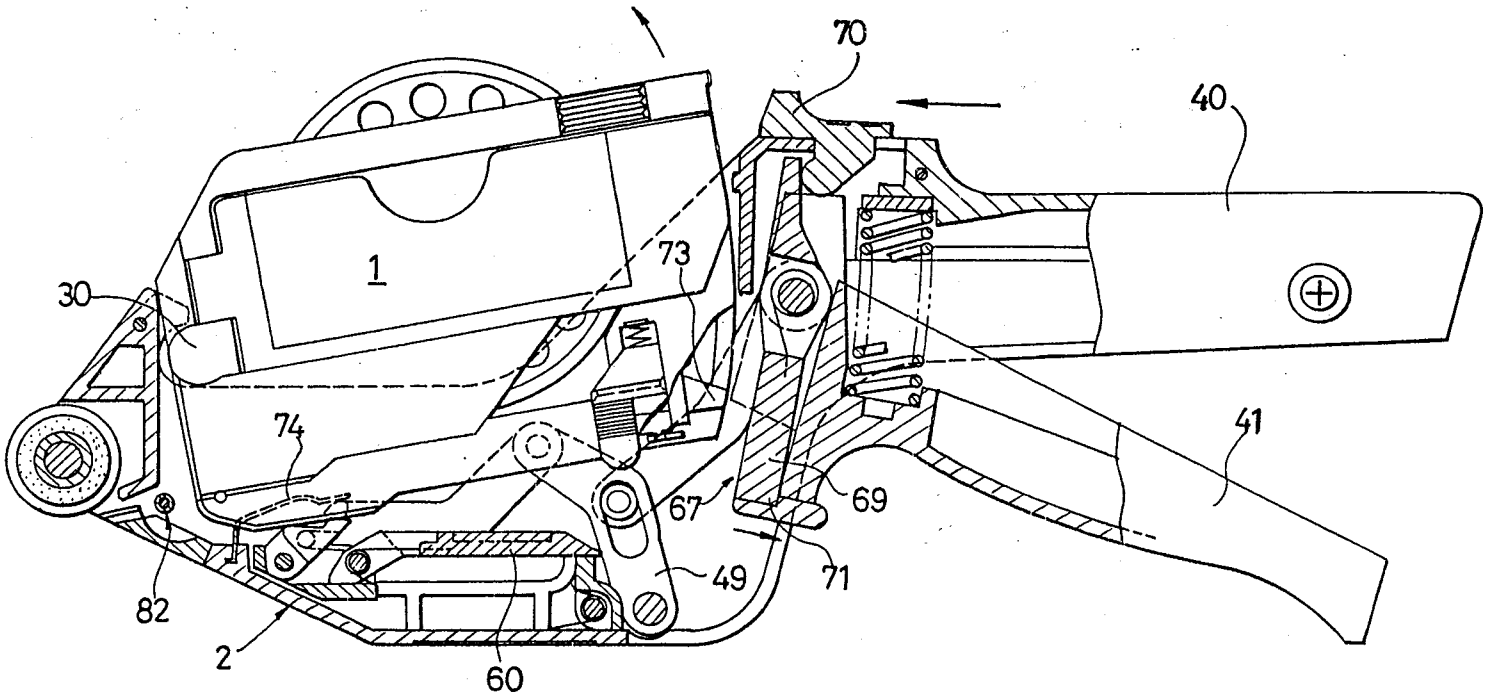
FIG. 13 is a partially sectional side view showing the label cassette being removed from the applier.
Figure 15:
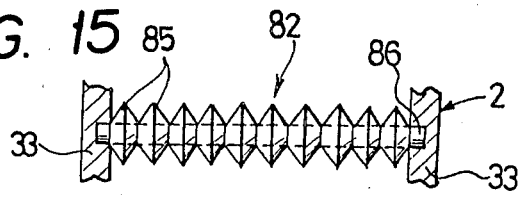
FIGS. 15 to 19 are external vews of various embodiments of auxiliary separating members.
Figure 16:
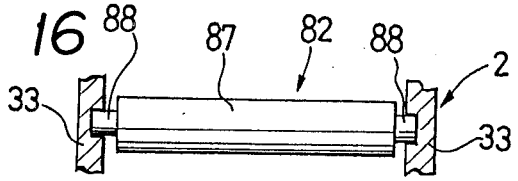
Figure 17:
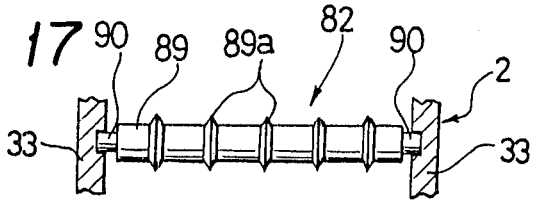
Figure 18:
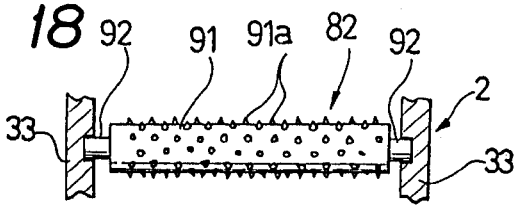

In order to remove the label cassette 1 from the applier 2, as shown in FIG. 13, the eject button 70 is pushed forward. The locking member 69 then pivots counterclockwise, and its lower end corner 71 is disengaged from the engaging member 73 of the label cassette 1. Simultaneously, the proximal portion of the label cassette 1 is slightly floated upward by the spring effect of the backing paper strip holder 74 which holds the lower surface of the backing paper strip 5 at a position in front of the backing paper strip guide groove 15. Then, the label cassette 1 may be readily removed.

The principle of operation of the auxiliary separating member 82 mounted on the applier 2 is now described. This principle, plus samples of auxiliary separating members, can be seen in U.S. application Ser. No. 452,705, filed Dec. 23, 1982. In general, if a label 6 of the label strip 4 has suitable rigidity and is sufficiently easily separated from the backing paper strip 5, the label 6 is separated from the backing paper strip 5 and is delivered to the label opeining 38 by means only of the inverting pin 16. However, less expensive labels may have insufficient rigidity depending upon the material from which they are formed. Furthermore, depending upon the properties or application conditions of a releasing agent or an adhesive applied to the backing paper strip 5 and the label 6, the labels 6 may be too strongly adhered to the backing paper strip 5. A label 6 adhered to the backing paper strip 5 in this manner may not be completely separated therefrom and may become inverted in its feeding direction together with the backing paper strip, thus causing erroneous printing or label jamming.

Figure 14:
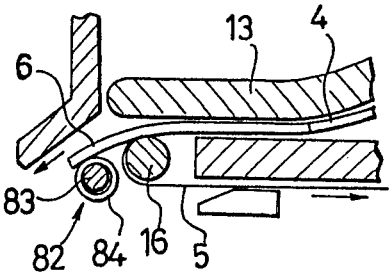
FIG. 14 is an enlarged sectional view of the main part of the same.

However, in the embodiment of the present invention, the auxiliary separating member 82 is incorporated at a position of the inverting pin 16, that is, at a position where the label 6 is separated from the backing paper strip 5. Therefore, a label 6 which has not been completely separated from the backing paper strip 5 and which is being inverted in its feeding direction together with the backing paper strip 5 becomes separated when its distal end abuts against the rotary body 84 and rotates it while moving, as shown in FIG. 14. During the separation process, the label 6 moves in contact with the rotary body 84. The rotary body 84 is rotated along the feeding direction of the label 6. For this reason, the contact resistance of the label 6 with respect to the auxiliary separating member 82 is extremely small, and the label 6 may be smoothly separated.

As described above, the auxiliary separating member 82 comprises a rotary body 84 and particularly a spiral body rotatable with respect to the pin 83. However, other arrangements as shown in FIGS. 15 to 18 may also be used. A rotary body 85 shown in FIG. 15 comprises a number of rolls which are rotatably supported by a pin 86 which is mounted so as to be stationary between the side walls of a frame 33 of an applier 2. In order to reduce the contact area with the label 6, the outer surface of each of these rolls is narrowed to a peak or ridge. A rotary body 87 shown in FIG. 16 comprises a roller which is formed integrally with a shaft 88 which is, in turn, rotatably supported by side walls of a cassette frame 33. Similar to the rotary body shown in FIG. 16, a rotary body 89 shown in FIG. 17 comprises a roller which is formed integrally with a rotatable shaft 90. In order to reduce the contact area with the label 6, the rotary body 89 has annular, narrowed peak projections or ridges **89*a* formed on its outer surface. A rotary body 91 shown in FIG. 18 comprises a roller which is formed integrally with a rotatable shaft 92. For the same purpose as in the case of FIG. 17, the rotary body 91 has a number of pointed, pinlike projections 91*a*** on the outer surface.

Figure 19:
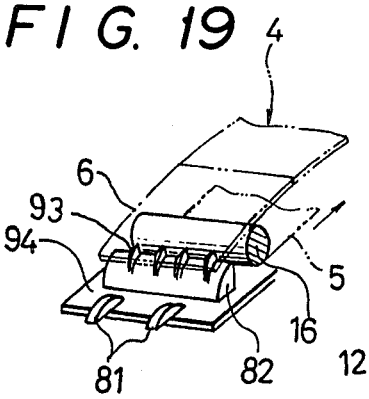

The auxiliary separating member is not limited to a rotary body as described above and may be held stationary as shown in FIG. 19. An auxiliary separating member 82 shown in FIG. 19 is fixed to a bottom plate 94 of an applier 2. A number of label abutment members 93 comprising narrow width projections are formed on the top surface of the auxiliary separating member 82 so as to reduce the contact area with the label 6.

Figure 20:
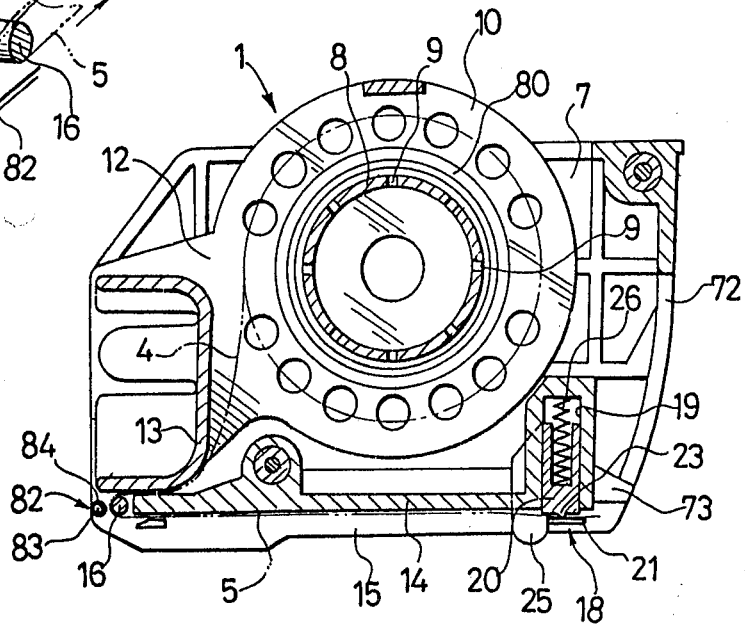
FIG. 20 is a sectional view showing a label cassette to be used in a portable label applying machine according to another embodiment of the present invention.

The auxiliary separating member 82 may be incorporated inside the label cassette 1, as shown in FIG. 20. Since the auxiliary separating member 82 is interposed between the side walls of a frame 7 and in front of an inverting pin 16, the backing paper strip 5 must be inserted between the inverting pin 16 and the auxiliary separating member 82 for inversion of the strip 5 after a label strip 4 has been wound into a roll. However, this initial backing paper strip insertion requirement may be eliminated if the auxiliary separating member 82 is formed integrally with the lower end portion of the distal end of the arcuate label holder 13 of the pivotal member 12.

In the embodiment described above, the feeding means for feeding the backing paper strip 5 comprises feeding pawls. However, other feeding means such as rollers may also be used.

A label cassette 1 used in the present invention may not only be set in a printer with a label strip 4 wound thereon, but also may be used with a printed label strip or a roll of label strip having non-printed labels adhered on a backing paper strip which is directly mounted on a core 8. In the latter case, the side frame or surface of the label cassette 1 is preferably free to open or close for allowing mounting of the wound roll of a label strip.

In summary, the present invention provides a label applying machine comprising a label cassette holding a roll of a label strip and an applier to which the label cassette is detachably mounted and which separates a label from the backing paper strip and applies it to an article. The label applying machine of the present invention provides the following advantages:

1. since printing can be performed by a separate printer, clearer and more precise printing may be performed than with a hand-held labeler. Especially in the case of printed bar codes, the check digits may be automatically calculated for printing.

2. Since the machine does not require a printing head, the machine itself may be made lighter in weight and smaller in size. As a result, the operability of the machine is improved and the application speed of labels onto goods is also improved. The user will experience less fatigue in working with the machine of the present invention.

3. Setting of the label cassette in the machine is simple and does not require insertion of the label strip into the applier.

4. The label application speed is faster and the printed surface of the labels may not be blurred or otherwise degraded, as compared with the conventional manual label application method.

5. Since an auxiliary separating member is incorporated at a position near the point of inversion of the backing paper strip, the labels can be completely and reliably separated from the backing paper strip. Therefore, erroneous application of the labels or machine problems due to jamming of the labels is prevented, so that a low-cost label strip with poor characteristics may also be used.

Although the present invention has been described in connection with a number of preferred embodiments, many variations and modifications will now become apparent to those skilled in the art. It is preferred, therefore, that the present invention be limited not by the specific disclosure herein, but only by the appended claims.

What is claimed is:

1. A portable label applying machine comprising:

a label cassette comprising a supporting section for supporting a roll of a label strip consisting of labels sequentially adhered on a backing paper strip and for feeding the label strip to a separating section of the cassette; a separating section for receiving the label strip fed thereto and for inverting the backing paper strip alone sufficiently to cause the labels to separate from the backing paper strip, and a guide section following the separating secton for guiding the backing paper strip which is inverted;

an applier having a manually operable feeding mechanism and a label applying section, the label cassette being detachably mounted on the feeding mechanism; the feeding mechanism engaging the backing paper strip at the guide section for transferring the backing paper strip after the strip is inverted in cooperation with the manual operation of the feeding mechanism so as to separate the labels from the backing paper strip, and the applying section being for applying the labels, which have been separated, to other goods; and an auxiliary separating member which is mounted forward in the path of the label strip of the position at which the backing paper strip is inverted, the auxiliary separating member being for aiding separation at the separating section.

2. The portable label applying machine of claim 1, wherein the feeding mechanism of the label applying device comprises a feed pawl and manually graspable means supported to the applying device and movable for, in turn, moving the feed pawl to move the backing paper web after the backing paper web has passed the peeling section.

3. The portable label applying machine of claim 1, further comprising:

a backing paper strip pressing mechanism to press and secure the backing paper strip at the guide section of the cassette and after the separating section.

4. The portable label applying machine of claim 1, wherein the auxiliary separating member is on the cassette.

5. The portable label applying machine of claim 4, wherein the separating section comprises means for deflecting and inverting the backing paper strip sufficiently sharply and in a direction that labels will normally separate from the backing paper strip as the backing paper strip advances past the deflecting means;

the auxiliary separating member being in the vicinity of the deflecting means, and including a label abutment portion positioned, shaped and sized such that a label, which might otherwise fail to separate from the backing paper strip at the deflecting means, instead abuts the abutment portion; the abutment portion being shaped for causing the label to ride over the abutment portion for separating the label from the backing paper strip.

6. The portable label applying machine of claim 5, wherein the abutment portion is freely rotatable upon engagement thereof by a label, and is rotatable for rotating in the advancing direction of the label and the backing paper strip, whereby the abutment portion will not resist the advance of a label thereover, for assisting separation of the label from the backing paper strip.

7. The portable label applying machine of claim 6, wherein the abutment portion comprises a roller supported to and extending across the cassette, the roller being a freely rotatable rotary member for rotating as and after the roller is abutted by a label.

8. The portable label applying machine of claim 7, wherein the roller has an outer circumference comprising a plurality of circumferential ridges spaced apart along the roller.

9. The portable label applying machine of claim 6, wherein the auxiliary separating member comprises a pin supported to and extending across the cassette along the deflecting means; the abutment portion comprising a freely rotatable rotary member carried on and rotatable about the pin for rotating as and after the rotary member is abutted by a label.

10. The portable label applying machine of claim 9, wherein the rotary member comprises a spirally wound element.

11. The portable label applying machine of claim 9, wherein the rotary member comprises a plurality of beads rotatably carried on the pin.

12. The portable label applying machine of claim 9, wherein the roller has an outer circumference comprising a plurality of teeth arrayed over and spaced apart over the surface of the roller.

* * * * *